US006457342B2

(12) United States Patent
Tanahashi et al.

(10) Patent No.: US 6,457,342 B2
(45) Date of Patent: Oct. 1, 2002

(54) FORGING DEVICE AND METHOD THEREFOR

(75) Inventors: Masanori Tanahashi; Yoshinori Ogata, both of Mie (JP)

(73) Assignee: Kabushiki Kaisha Kobe Seiko Sho, Kobe (JP)

( * ) Notice: Subject to any disclaimer, the term of this patent is extended or adjusted under 35 U.S.C. 154(b) by 0 days.

(21) Appl. No.: 09/790,607

(22) Filed: Feb. 23, 2001

(30) Foreign Application Priority Data

Feb. 24, 2000 (JP) ..... 2000-046877

(51) Int. Cl.[7] ..... B21D 37/16
(52) U.S. Cl. ..... 72/364; 72/342.1; 72/356
(58) Field of Search ..... 72/364, 342.1, 72/404, 306, 356

(56) References Cited

U.S. PATENT DOCUMENTS

| | | | | |
|---|---|---|---|---|
| 752,411 A | * | 2/1904 | Paterson | 72/364 |
| 1,935,742 A | * | 11/1933 | Hager | 72/356 |
| 3,453,855 A | * | 7/1969 | Morita | 72/306 |
| 3,584,487 A | * | 6/1971 | Carlson | 72/364 |
| 3,796,082 A | * | 3/1974 | Honsinger et al. | 72/256 |
| 5,374,323 A | * | 12/1994 | Kuhlman et al. | 72/377 |

FOREIGN PATENT DOCUMENTS

| | | |
|---|---|---|
| JP | 49-75407 | 7/1974 |
| JP | 49-78610 | 7/1974 |

* cited by examiner

*Primary Examiner*—Daniel C. Crane
(74) *Attorney, Agent, or Firm*—Oblon, Spivak, McClelland, Maier & Neustadt, P.C.

(57) ABSTRACT

A forging device and a method therefor that enables improve forging precision of a work and lengthen life of dies of a forging device, by efficiently heating the work chiefly made of aluminum in one heating furnace, wherein the device has: a heating furnace for heating works W while moving the works W along the movement path; an intermediate processing means, disposed in the midst of the movement path in a heating furnace, for intermediately forming works W; an intermediate conveyance means for conveying works W from the heating furnace to the intermediate processing means; and a final processing means for making the intermediate conveyance means convey the intermediately formed works W to the heating furnace, reheating the conveyed the works W, and finally processing to form the works W.

9 Claims, 4 Drawing Sheets

FORGING DEVICE AND METHOD THEREFOR

BACKGROUND OF THE INVENTION

The present invention relates to a forging device and a method for forging works chiefly made of aluminum, and particularly to the forging device and the method for heating works prior to both intermediate and final forming in one heating furnace.

In the conventional process of forming a flat or a pipe work to produce an automobile part, etc., plural process such as bending, roll forging, and rough die press are sequentially applied to thereby form complex-form works,precisely.

The forging device, for forging works by using a heating furnace, moves the works while heating the works in a heating furnace, takes the heated works out of the heating furnace when the works reaches to end point of the movement path, and intermediately forms the work, followed by final forming thereof.

Such forging device heats the works in its heating furnace prior to each of the processes to thereby improve the precision in formation of the works and lengthen life of a forging die.

Since the temperature of a work made of iron or steel hardly falls, it is enough to heat the work only once before executing first forming process, whereas the temperature of a work chiefly made of aluminum easily falls, and also the aluminum work needs to be heated at the most 400° C. in the heating furnace when forming the work. Therefore, only once an aluminum work is heated in the beginning of formation process, the temperature of the work tends to fall during its formation process, deteriorating precision of the formation process as well as shortening life of dies.

In order to compensate for the defect in coping with an aluminum work, a work chiefly made of aluminum is forged by a forging device having plural small preheating furnaces, for heating the aluminum work before intermediately forming the aluminum work at each processing stage.

On the other hand, publicly-known technology in forging field uses a circular heating furnace in which a billet subject for heat processing is heated to a temperature most appropriate for forging while moving the billet along an annular path therein. J-P-A-Nos. 49-75407 and 49-78610 describe examples of the technique. Those attempts were thus made to introduce such annular heating furnace in forging device to achieve efficient outcomes of the entire forging process and to make the layout of the annular heating furnace compact.

In these prior arts, for heating a work in a heating furnace while moving the work along an annular path thereof, however, one heating furnace is provided only for one process.

Nevertheless, the forging device for forging a work chiefly made of aluminum needs to be equipped with plural heating furnaces each of which is to be separately installed for each of the processes, accompanied with work conveyance and transshipment facilities, and, as a consequence, the entire forging device and facilities have become large in size.

Further, because the necessity of separately coping with each of the heating furnaces causes the increase in heating energy consumption and in the man-hour control of the heating furnaces.

SUMMARY OF THE INVENTION

The present invention aims to solve the problems, and to provide a forging device and a method for efficiently heating a work chiefly made of aluminum in one heating furnace to thereby forge the work precisely and lengthen a die life of a forging device.

The present invention provides a forging device having: a heating furnace for heating a work while moving the work along a movement path; an intermediate processing means, connected to a point in the midst of movement path, for intermediately forming the work; an intermediate conveyance means for conveying the work from the heating furnace to the intermediate processing means and for conveying the intermediately formed work from the intermediate processing means to the heating furnace; and a final processing means for finally forming the intermediately formed work reheated in the heating furnace.

A forging device of the present invention uses one heating furnace to heat a work prior to both intermediate and final forming processes, and thereby enabling the installation area of the forging device to be reduced and the work to be heated efficiently.

Further, in the forging device of the present invention, the movement path in the heating furnace can be made annularly. Since the movement path is made annularly, the installation area of the forging device can be reduced. And, since plural works are heated in the heating furnace while being moved along the movement path, the plural works can be heated efficiently.

Furthermore, in the forging device of the present invention, an opening/closing door can be provided, for conveying the works to the intermediate processing means, to be installed on the side wall of the heating furnace.

Moreover, in the device of the present invention, plural works can be loaded onto a conveyance tray, and can be moved along the movement path in the heating furnace, and an intermediate conveyance means can be provided to convey the works between the heating furnace and the neighborhood of the intermediate processing means.

According to the present invention, because plural works can be coped with in the heating furnace and by the intermediate conveyance means at a time, the overall processing of works can be coped with efficiently compared with the processing where works is processed one by one.

Further, in the present invention, the intermediate conveyance means can be composed of a guide rail installed so as to take works out of the heating furnace and a rotary table to enable part of the guide rail to be moved rotatively together with the works.

The use of the rotary table enables raw works and processed works to be easily interchanged with each other, and thereby enhancing the work efficiency.

Moreover, the present invention provides a forging method using the aforementioned forging device having: a conveyance step for conveying works into the heating furnace; first heating step for heating the works while moving them along a movement path inside the heating furnace; an intermediate conveyance step for conveying the works, in the midst of the movement path, from the heating furnace to the intermediate processing means; an intermediate forming step for forming the works by the intermediate processing means; an intermediate conveyance step for conveying the intermediately processed works from the intermediate processing means to a point in the midst of the movement path; the second heating step for heating the works, in the heating furnace while moving the remaining works along the movement path; a take-out step for taking the works being at the terminal of the movement path out of the heating furnace; and a final processing step for finally forming the works conveyed at the take-out step.

According to the present invention, works can be heated by one heating furnace prior to both intermediate and final forming processes, and thereby reducing the installation area of the entire forging device and heating the works efficiently.

The forging method of the present invention is particularly applicable to a work chiefly made of such material as aluminum work which easily gets cold.

DETAILED DESCRIPTION OF THE PREFERRED EMBODIMENTS

Preferred embodiments of the present invention will be described as follows referring to the attached drawings.

Figure 1:
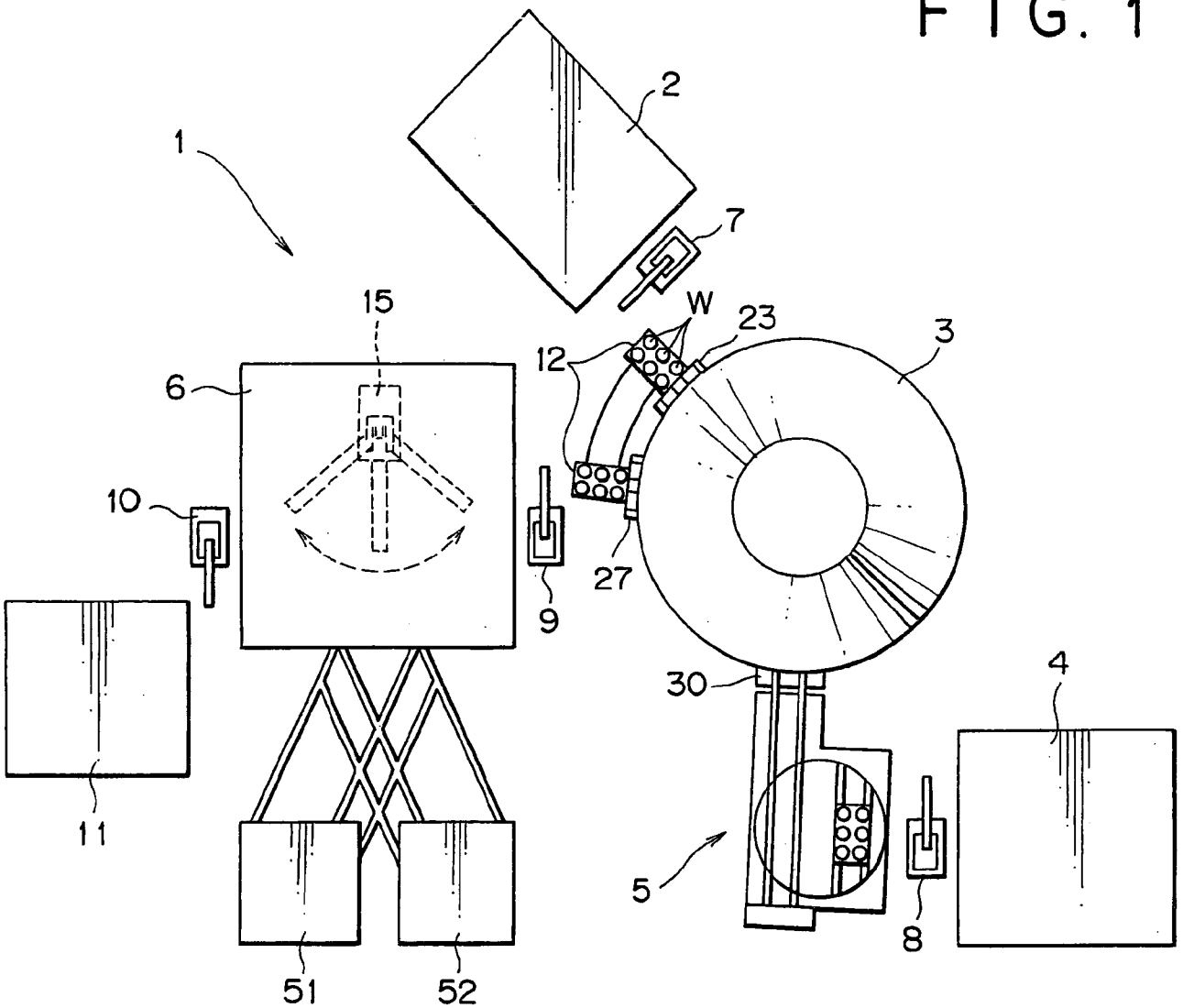
FIG. 1 is a plan view showing the entire configuration of the forging device of the present invention.

FIG.1 is the entire view of the forging device using the heating method for forging. The forging device 1 has: a work stocker 2 for storing works W; an annular heating furnace 3 for heating works W; an intermediate processing means 4 for intermediately forming the heated works W; an intermediate conveyance means 5 for conveying works W from a heating furnace 3 to an intermediate processing means 4; and a final processing means 6 for finally forming intermediately formed works. Further, in this embodiment, works W are mounted on conveyance tray 12, to be detailed later, and then are moved in the heating furnace 3 and on the intermediate conveyance means 5.

The work stocker 2 makes plural works line up and stores the works therein. Further, a robot arm 7 for mounting the works W on a conveyance tray 12 on standby outside the heating furnace 3, is installed between the work stocker 2 and the heating furnace 3. Similarly, robot arms 8 and 9 for conveying the works W are installed between an intermediate conveyance means 5 and an intermediate processing means 4, and between a heating furnace 3 and a final processing means 6, respectively.

Further, the forging device 1 is provided with: a trimming press machine 11 for trimming works W finally formed by the final processing means 6, and a robot arm 10 for moving the works W from the final processing means 6 to the trimming press machine 11.

Additionally, recommendable works W are alloys chiefly made of aluminum. Further, the works W may have such arbitrary shapes as plate, bar, pipe, etc.

Figure 2:
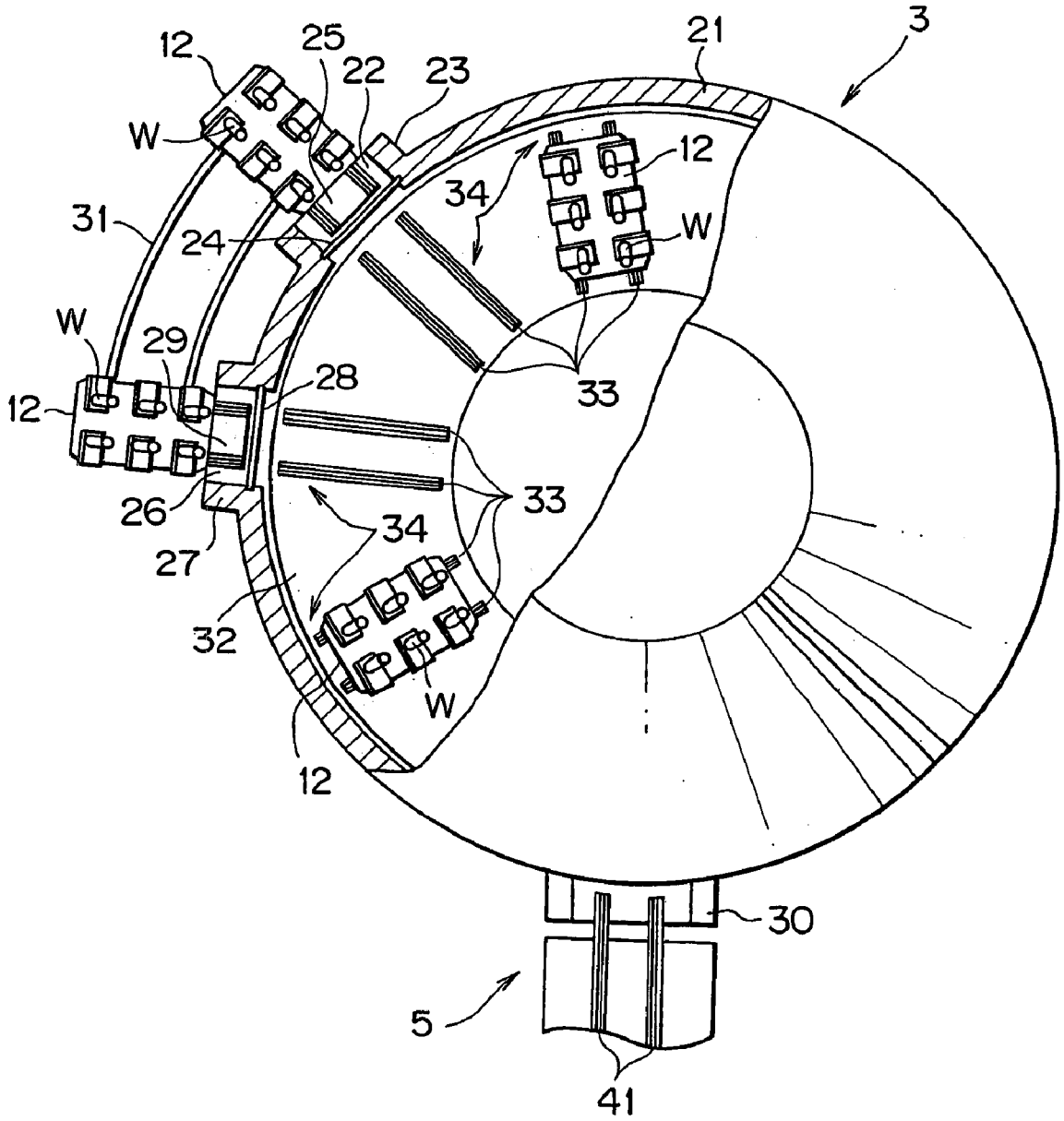
FIG. 2 is a partially broken-out plan view of the heating furnace of the present invention.

As shown in FIGS. 1 and 2, the heating furnace 3 has: an annular movement path for works W; a port 23 which is formed to have opening 22 in the position facing the work stocker 2..on a side wall 21 of the heating furnace 3, for a conveying the conveyance tray 12 loaded with the works W in the heating furnace 3; and an opening/closing door 24 for closing the opening 22. Further, a port 23 is connected to a taking-in table 25 for keeping the conveyance tray 12 on standby until loading of the works W onto the conveyance tray 12 is completed.

Further, the port 27 having an opening 26 for taking out the conveyance tray 12 of the heating furnace 3, and an opening/closing door 28 for closing the opening 26 are installed in a position facing the final processing means 6 on a sidewall 21 of the heating furnace 3. Furthermore, a take-out table 29 is connected to port 27 in order to keep conveyance tray 12 on standby until the works W which have been taken out of port 27 are introduced in the final processing means 6.

Moreover, a port 30 for taking the conveyance tray 12 out of heating furnace 3 is installed at a position of side wall 21 in the heating furnace 3, which position facing intermediate conveyance means 5.

Additionally, an empty conveyance tray 12 from which works W have been taken in the final processing means 6 is moved to a taking-in table 25, along conveyance means 31 installed to connect the taking-in table 25 with the taking-out table 29, and then is loaded with next works at the taking-in table 25 and is again conveyed to the heating furnace 3.

A conveyance means 31 then makes an engaging section (not shown in the drawings) link to conveyance tray 12 to thereby move the empty conveyance tray 12 from the taking-out table 29 to the taking-in table 25. The engaging section, after moving the empty conveyance tray 12 to the taking-in table 25, returns to a standby position on the side of conveyance table 29, and stands by to get ready for next movement of the conveyance tray 12.

Further, taking the conveyance tray 12 from or in the heating furnace 3 is executed by the take in/out mechanisms, not shown in the drawings, respectively installed in taking-in table 25 and taking-out table 29.

The heating furnace 3 has an annular rotary bed 32 installed therein, above which plural gas burners are installed, whereby works W which are taken in heating furnace 3 are heated to a required temperature.

The rotary bed 32 has plural guide sections 34, each consisting of two parallel rails 33 disposed radially from the center of rotary bed 32. When the conveyance tray 12 from port 23 is carried in the heating furnace 3, this guide section 34 fits in a concave (not shown in the drawings) formed on the undersurface of the conveyance tray 12, whereby the conveyance tray 12 is fixed to rotary bed 32.

The heating furnace moves the conveyance tray 12 in rotary direction of the rotary bed 32 as it rotates, and stops rotation when the conveyance tray 12 reaches to the work forming position of each of ports 23, 27, and 30. Further, when the conveyance tray 12 from the ports 23 or 30 is conveyed in the heating furnace 3, the rotary bed 32 starts to move. Additionally, the speed and the amount of rotation of the rotary bed 32 can be adjusted in conformity with the final process time.

Then, the movement path along which works W move while being heated is a path along which works W rotate inside the heating furnace 3, wherein the position to which the conveyance tray 12 is taken in from the port 23 is defined as start point thereof and the position to which the conveyance tray 12 is taken out of the port 27 is defined as end point thereof.

Figure 3A:
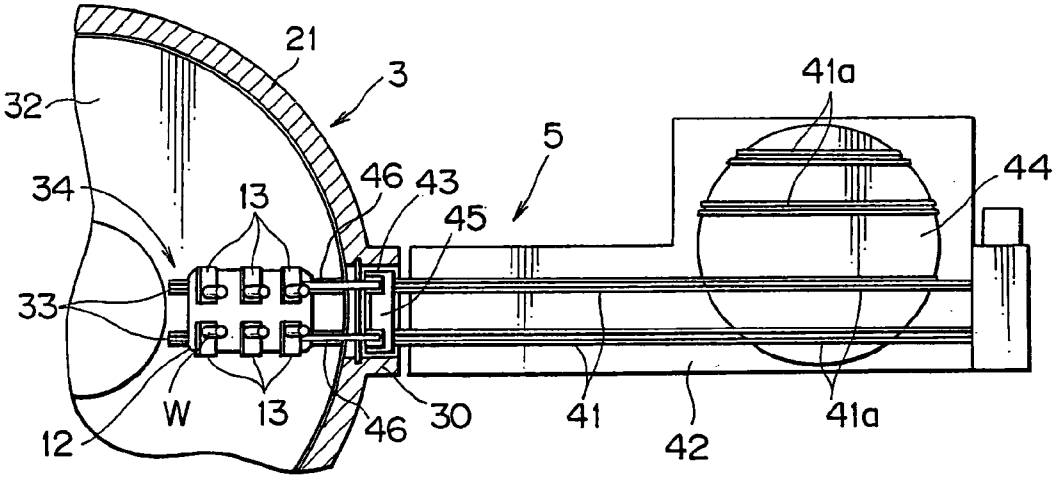
FIG. 3A is a partially broken-out plan view.
Figure 3B:
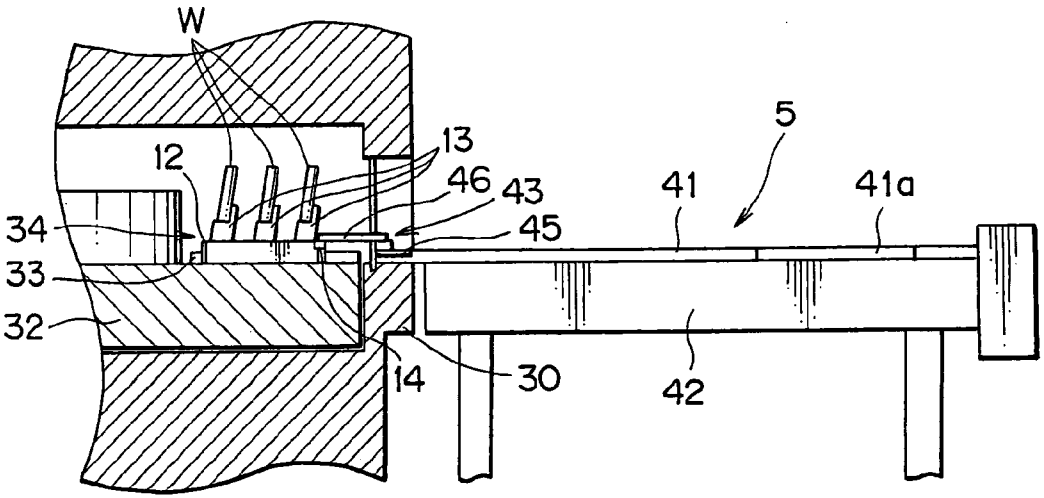
FIG. 3B is a side view of the intermediate conveyance means of the present invention.

As shown in FIGS. 3A and 3B, there are six work holders 13 fixed to the conveyance tray 12, for arranging works W so as to be laid out, on the upper surface of the conveyance tray 12, at even intervals and aslant to conveyance tray 12. Further, the upper surface of conveyance tray 12 has groove 14 for the coupling hook section 46 of guide means 43 of intermediate conveyance means 5 to be engaged (to be detailed hereinafter). Furthermore, there is a concave (not shown in the drawings) formed on the undersurface of conveyance tray 12, for the rail 33 of the guide section 34 of the rotary bed 32 to be fitted therein.

The intermediate processing means 4 consists of publicly-known forming process devices for bending, contracting, roll-forging, rough die pressing, etc. of works heated inside heating furnace 3. Although only one intermediate forming means 4 is shown in FIG. 1, the forging device of the present invention may have plural intermediate forming means 4 different in kind. Further, the forging device of the present invention can also shorten the intermediate forming process time by installing plural intermediate processing means 4 of the same kind in the forging device.

The intermediate conveyance means 5 for conveying works W heated inside the heating furnace 3 to the intermediate processing means 4 has two guide rails 41 extending linearly in parallel from port 30 with one ends thereof being connected to the port 30 of heating furnace 3; the base 42 for bearing guide rails 41, the guide means 43, for taking out the conveyance tray 12 from the heating furnace 3 and for conveying the conveyance tray 12 along guide rails 41; and the rotary table 44 for horizontally and rotatively moving the conveyance tray 12 conveyed along the guide rails 41 as far as an insert position at which conveyed conveyance tray 12 is to be inserted in intermediate processing means 4.

The size and installation interval of two guide rails 41 are the same as those of two guide rails 33 of the guide section 34 installed on the rotary bed 32 in the heating furnace 3, and the cross-section of each of the guide rails 41 forms such a concave that the central section on the upper side is concaved.

The guide means 43 for conveying the conveyance tray 12, between the heating furnace 3 and the rotary table 44, along the guide rails 41 has a table 45 installed so as to be stretching between two guide rails 41, and two vertically movable coupling hook sections 46 installed in the table 45 on the side of heating furnace 3.

Under the table 45 of the guide means 43, provided is a driving means such as a tire which fits with a play to the concaved sections of the guide rails 41. The guide means 43 can be driven by the driving means to move along guide rails 41.

The coupling hook section 46, when the conveyance tray 12 is on the rotary bed 32 or the rotary table 44, is vertically moved to engage the coupling hook section 46 in the groove 14 of the conveyance tray 12 or to release the engagement, and thereby connecting conveyance tray 12 and guide means 43 or releasing the connection thereof.

Further, the position of the guide means 43 is controlled by the position detecting sensors (not shown in the drawings) installed in the port 30 and the base 42. As an example, when the opening/closing door of port 30 is closed, on receiving a signal from the position detecting sensor installed in port 30, the guide means 43 stands by at a standby position apart a predetermined distance from the port 30; and when the position detecting sensor detects that the opening/closing door is open, the guide means 43 enters the heating furnace 3, is connected to the conveyance tray 12, and then takes out the conveyance tray 12 of the heating furnace 3. Additionally, the standby position of the guide means 43 is defined as the installation position of the position detecting sensor installed in the base 42, and when this position detecting sensor detects the guide means 43, the guide means 43 is stopped to be kept on standby at this position until the opening/closing door is opened.

Two pairs of partial sections 41*a* of the guide rails 41 are rotatively and symmetrically disposed in rotary table 44. The rotary table 44 rotates the conveyance tray 12 together with two pairs of partial sections 41*a* of the guide rails 44 horizontally by 180° when the conveyance tray 12 comes to the rotary table 44. Further, when the rotary table 44 is rotated horizontally by 180°, the position to which the conveyance tray 12 comes is the position for works W to be inserted in the intermediate processing means 4.

Furthermore, the final processing means 6 is a mechanical press machine which presses works W through three steps. The works W are pressed by the robot arm 15 through sequential three steps (shown as a broken line in FIG. 1) so as to be formed into final shapes. Two types of dies 51 and 52 conforming to the final shapes of the works W are interchangeably installed in the final processing means 6, and the finally formed works W are executed by press trimming device 11 to undergo trimming, and thereby unnecessary portion is removed from the finally formed works W.

Moreover, although the present embodiment uses a robot arm 15 to move works W, it may be designed to use a belt conveyor to convey works W sequentially one by one. Additionally, the number of interchangeable dies is not necessarily limited to two, it may be designed to use an arbitrary number of interchangeable dies.

Hereinafter, the procedure for conveying two conveyance trays 12 by intermediate conveyance means 5 to form works on those conveyance trays continuously by intermediate processing means 4 will be explained using FIGS. 1, 3A, 3B, 4A, 4B, 4C, and 4D as follows. In this connection, the conveyance tray with works W1 to be intermediately formed firstly by intermediate processing means 4 is referred to as a conveyance tray 12*a*, and the conveyance tray with works W2 to be intermediately formed next by the intermediate processing means 4 is referred to as a conveyance 12*b*.

First, as shown in FIG. 3, when the conveyance tray 12*a* reaches to the forming position of the port 30, the rotary bed 32 stops and the opening/closing door of the port 30 opens, whereby guide means 43 which was standing by outside the heating furnace 3 enters the heating furnace 3, and the conveyance tray 12*a* is connected to the guide means 43 by the coupling hook 46. The conveyance tray 12*a* is then conveyed by the guide means 43 along the guide rails 41 to the conveyance table 44 (see FIG. 4A).

Figure 4A:
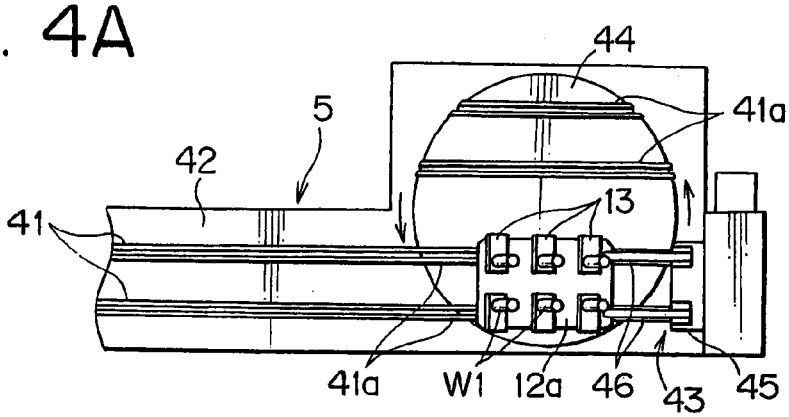
FIGS. 4A, 4B, 4C and 4D are explanatory views for explaining the action of the intermediate conveyance means of the present invention.
Figure 4B:
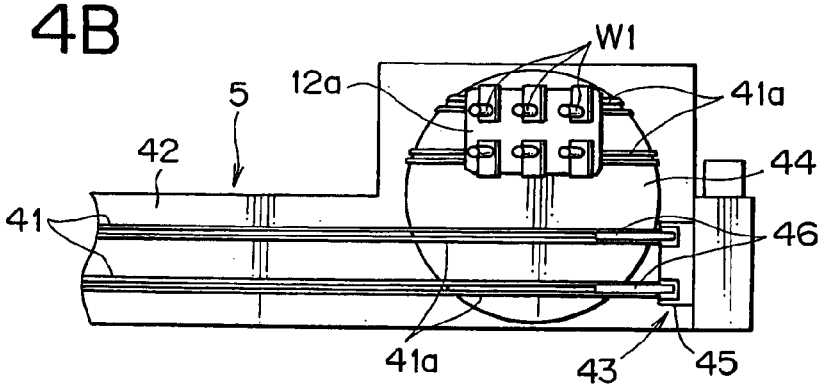

The coupling hook 46 of the guide means 43 then moves upward, and after the connection between the preceding conveyance tray 12*a* and the guide means 43 is released, the rotary table 44 rotates by 180° in the arrow-head direction shown in FIG. 4A to move the conveyance tray 12 together with a pair of the partial sections 41a of the guide rails 41 as far as the insert position of the intermediate processing means 4.

At the insert position, the works W1 on the conveyance tray 12*a* are inserted one by one in the intermediate forming means 4 by the robot arm 8 shown in FIG. 1. The intermediate processing means 4 executes, as an example, roll forging on inserted works W1, and the intermediately formed works W1 are returned again by the robot arm 8 to the original position of the preceding conveyance tray 12*a*.

Figure 4C:
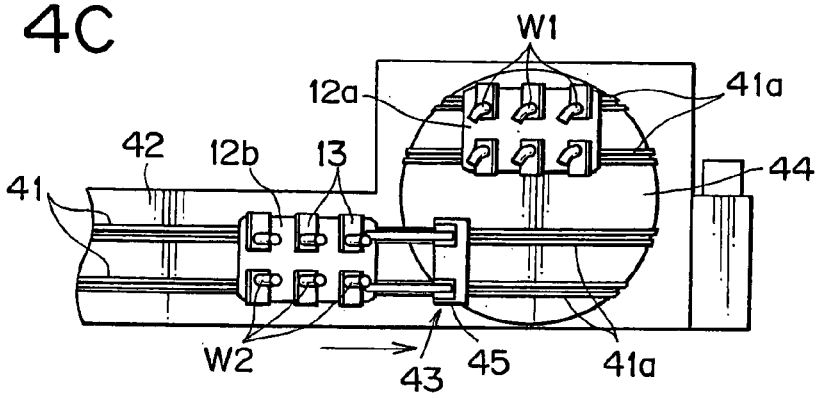
Figure 4D:
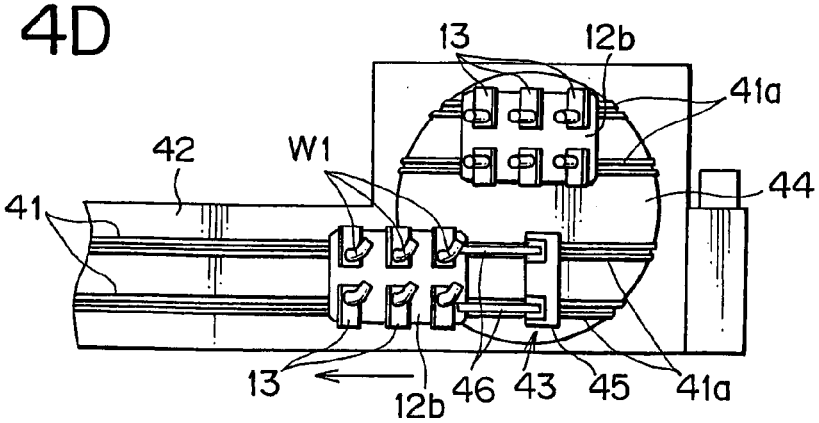

During the aforementioned operation, the guide means 43 moves again to the standby position on the heating furnace 3 side in order to make preparation for the next conveyance tray 12*b* to come. When the intermediate forming of fourth or fifth works out of the works W1, which are on the conveyance tray 12*a*, is completed, as aforementioned, the fourth or fifth works of the works W1 is loaded on the guide means 43, and the conveyance tray 12*b* is taken out of the heating furnace 3 and is conveyed to the rotary table 44, as shown in FIG. 4C.

When intermediate forming of works W1 which are on the conveyance tray 12*a* is all completed, the rotary table 44 is again rotated to interchange the position of the conveyance tray 12*a* with the next conveyance tray 12*b*, whereby works W2 on the conveyance tray 12*b* which has moved to the insert position are intermediately formed by the intermediate forming means 4, while the conveyance tray 12*a* is again inserted in the heating furnace 3 by the guide means 43.

As aforementioned, since the use of rotary table 44 enables the conveyance trays 12 to be interchanged rapidly, the intermediate processing time can be shortened, and the temperature drop of works W can be stemmed to the minimum. Accordingly, intermediate processing of works W can be achieved efficiently and precisely.

Next, the method for forming works W made of aluminum alloy pipe material using the forging device 1 of the present invention will be described as follows.

Firstly, six works out of the works W in store on the work stocker 2 are mounted by the robot arm 7 in the conveyance tray 12 which is standing by on conveyance table 25.

When the works W are mounted in the conveyance tray 12, the opening/closing door 24 of the port 23 of the heating furnace 3 opens, wherefrom the conveyance tray 12 is conveyed in the guide section 34 which is the start point of the annular movement path on rotary bed 32.

Next, the opening/closing door 24 is closed, the rotary bed 32 starts to move at a predetermined speed in a rotary direction, and the conveyance tray 12 and the works W, while being moved in the rotary direction along the movement path, are heated to around 400° C. by the gas burners installed above the rotary bed 32.

When the conveyance tray 12 reaches to the position of the port 30 which is on the movement path, the rotary bed 32 stops, and the opening/closing door of this port 30 opens. Then, the guide means 43 on standby outside the opening/closing door enters the heating furnace 3, and engages the coupling hook 46 with the groove 14 of the loading tray 12 to connect the conveyance tray 12 with the guide means 43.

The conveyance tray 12 is then conveyed by the guide means 43 from the inside of the heating furnace 3 to the rotary table 44 along the guide rails 41.

The conveyance tray 12 which has been conveyed to the rotary table 44 is moved, by the horizontal rotation of the rotary table 44, to the insert position of the intermediate forming means 4, at which the works W on the conveyance tray 12 are intermediately formed.

Next, the conveyance tray 12 loaded with the intermediately formed works W is again taken in the heating furnace 3 by the guide means 43. Additionally, it is preferable to close the opening/closing door of the heating furnace 3 once after the conveyance tray 12 is taken out, in order to prevent the temperature of the heating furnace 3 from falling, and to open the opening/closing door when taking the conveyance tray 12 loaded with intermediately formed works W in the heating furnace 3.

Although the temperature of the works W which have been intermediately formed and have returned to the heating furnace 3 is down to around 350° C., the works W are reheated to around 400° C. while moving the works W along the movement path in the heating furnace 3. When the conveyance tray 12 reaches to the position of the port 27, the terminal of the movement path, rotary bed 32 stops rotation, the opening/closing door 28 opens, and the conveyance tray 12 is taken out of the heating furnace 3 to the conveyance table 29. Additionally, after the conveyance tray 12 is taken out of the heating furnace 3, the opening/closing door 28 of the port 27 is closed.

The works W which are loaded on the conveyance tray 12 on the conveyance table 29 are sequentially inserted in the final processing means 6 by the robot arm 9. The works W which have been formed into a final shape by the final processing means 6 are then trimmed by the trimming press machine 11 to thereby complete the entire process. The conveyance tray 12 which is made empty of works W after inserting all of six works W from the conveyance tray 12 into the final processing means 6 is moved from the conveyance table 29 to the conveyance table 25, and stands by on the conveyance table 25 until next works W are loaded thereon.

Forging of works W is continuously executed by repeating the aforementioned operation.

Reheating of works W, not yet finally formed, by the heating furnace 3 enhances the processing precision of final forming of the works W, and can lengthen life of the forging dies of the final forming means 6.

Further, heating of works W prior to both intermediate and final forming processes by one heating furnace 3 enables the entire forging device to be made compact compared with the case where the intermediate and final heating processes are executed by using separate heating furnaces 3, and thereby reducing production cost.

Furthermore, because heating furnace 3 is made annular, the area of the side wall 21 can be reduced compared with that of linear-form heating furnace 3, and heat concentrating section can be easily prepared, and thereby controlling the temperature of heating furnace 3 with less energy consumption.

Moreover, time required for each process is designed to be adjusted to the final processing which requires the longest time among the processes: the moving speed of the rotary bed 32 in the heating furnace 3 is reduced; and the next conveyance tray 12 is made to be on standby at the terminal of the movement path until the final process of the conveyance tray 12 terminates. Incidentally, it is preferred to execute the adjustment of the processing time in the heating process or in the heating furnace 3, whereby the forging process of works W can be executed efficiently, and particularly the drop in temperatures of works W and conveyance tray 12 prior to the final forging process can be stemmed to the minimum, to thereby enhance the precision of the final forging and lengthen life of forging dies for use in final processing means 6.

Additionally, the present invention is not limited in the preferred embodiments. For example, the number of works W to be loaded on conveyance tray 12 may be arbitrary. Further, works W may be moved one by one inside the heating furnace 3 or may be conveyed by the intermediate conveyance means 5 without using the conveyance tray 12.

Furthermore, the forging device of the present invention may be designed to install plural types of the intermediate processing means 4 along the movement path of the heating furnace 3 so that timely selection of necessary intermediate processing means 4 can be executed in accordance with a final form of works W.

Moreover, the configuration of heating furnace 3 may have an arbitrary shape such as linear shape, and the shape of the movement path inside the heating furnace 3 may also be linear or curved. Although the heating furnace 3 uses a gas furnace heated by gas burners, any type of heating furnaces such as induction heating furnace may be used for the heating furnace 3.

Additionally, in order to minimize the drop in temperature inside the heating furnace 3 caused by taking works in and out of the heating furnace 3, it is also possible to take conveyance tray 12 in and out of the heating furnace by installing a preheating chamber outside the opening/closing door.

In addition, works W which need not be intermediately processed are taken in the heating furnace 3 from the port 23, and taken out of the port 27 without intermediate forming, followed by executing final forming process on the works W.

What is claimed is:

1. A forging device, comprising:

a heating furnace for heating a work while moving the work along a movement path in said heating furnace, an intermediate processing means, being connected at a point in the midst of the movement path, for intermediately forming the work, an intermediate conveyance means for conveying said work from said heating furnace to said intermediate processing means, and for conveying the intermediately formed work from said intermediate processing means to said heating furnace, and a final processing means for finally forming the intermediately formed work reheated in said heating furnace.

2. The forging device according to claim 1, wherein said movement path inside said heating furnace is formed into an annular shape.

3. The forging device according to claim 1, wherein the side wall of said heating furnace has an opening/closing door for conveying said work to said intermediate processing means.

4. The forging device according to claim 1, wherein a plurality of said works in the state of being loaded on a conveying tray are moved along said movement path inside said heating furnace and are conveyed by said intermediate conveyance means between said heating furnace and a neighborhood of said intermediate processing means.

5. The forging device according to claim 1, said intermediate conveyance means comprising guide rails designed for said intermediate conveyance means to take said work out of said heating furnace, and a rotary table for horizontally and rotatively moving part of said guide rails together with said work.

6. The forging device according to claim 4, said intermediate conveyance means comprising guide rails designed for said intermediate conveyance means to take said work out of said heating furnace, and a guide means for moving said conveyance tray on said guide rails by moving the conveyance tray along said guide rails.

7. The forging device according to claim 6, said intermediate conveyance means further comprising a rotary table for making said intermediate conveyance means horizontally and rotatively move part of said guide rails together with said work.

8. A forging method using forging device having a heating furnace for heating a work while moving the work along a movement path in said heating furnace, an intermediate processing means, being connected at a point in the midst of the movement path, for intermediately forming the work, an intermediate conveyance means for conveying said work from said heating furnace to said intermediate processing means, and for conveying the intermediately formed work from said intermediate processing means to said heating furnace, and a final processing means for finally forming the intermediately formed work reheated in said heating furnace, comprising the sequential steps of:

taking a work into said heating furnace, heating said work in said heating furnace while moving the work along the movement path, conveying said work, in the midst of the movement path, from said heating furnace to said intermediate processing means, intermediately forming said work by said intermediate processing means, taking said intermediately formed work out of said intermediate processing means at a point in the midst of the movement path, heating said work in said heating furnace while moving the remaining part inside said heating furnace, taking said work, at the terminal of the movement path, out of said heating furnace, and finally processing to form said work taken out of said heating furnace in said conveyance process.

9. The forging method according to claim 8, wherein said work is chiefly made of aluminum.

* * * * *